US008936360B2

(12) United States Patent
Fujisawa

(10) Patent No.: US 8,936,360 B2
(45) Date of Patent: Jan. 20, 2015

(54) IMAGE FORMING APPARATUS

(75) Inventor: Kazutoshi Fujisawa, Okaya (JP)

(73) Assignee: Seiko Epson Corporation, Tokyo (JP)

( * ) Notice: Subject to any disclaimer, the term of this patent is extended or adjusted under 35 U.S.C. 154(b) by 153 days.

(21) Appl. No.: 13/456,390

(22) Filed: Apr. 26, 2012

(65) Prior Publication Data

US 2012/0287214 A1 Nov. 15, 2012

(30) Foreign Application Priority Data

May 10, 2011 (JP) ..... 2011-105636

(51) Int. Cl.
*B41J 2/01* (2006.01)
*B41J 11/00* (2006.01)
*B41J 25/304* (2006.01)

(52) U.S. Cl.
CPC ..... *B41J 11/002* (2013.01); *B41J 25/304* (2013.01)
USPC ..... 347/102; 347/101

(58) Field of Classification Search
USPC ..... 347/102, 104, 101
See application file for complete search history.

(56) References Cited

U.S. PATENT DOCUMENTS

| | | | | |
|---|---|---|---|---|
| 6,612,691 | B1 * | 9/2003 | Koitabashi et al. | 347/105 |
| 2001/0017085 | A1 * | 8/2001 | Kubo et al. | 101/35 |
| 2003/0184631 | A1 | 10/2003 | Suzuki et al. | |
| 2006/0238565 | A1 * | 10/2006 | Jung et al. | 347/37 |
| 2007/0008361 | A1 * | 1/2007 | Kawatoko et al. | 347/12 |
| 2008/0211853 | A1 * | 9/2008 | Nagashima | 347/19 |

FOREIGN PATENT DOCUMENTS

| | | |
|---|---|---|
| JP | 2004-167917 | 6/2004 |
| JP | 4259098 | 6/2004 |
| JP | 2004-314304 | 11/2004 |
| JP | 2006-159852 | 6/2006 |

* cited by examiner

*Primary Examiner* — Manish S Shah
*Assistant Examiner* — Yaovi Ameh
(74) *Attorney, Agent, or Firm* — Workman Nydegger

(57) ABSTRACT

A nozzle surface (nozzle plate) of a printing head which ejects UV-curable ink from a nozzle is tilted with a predetermined inclination angle θ with respect to the recording surface of a recording sheet so as to face the opposite side to an ultraviolet irradiator. In this manner, it is difficult for the ultraviolet light which is radiated from the ultraviolet irradiator, and is reflected on the recording sheet to input to the nozzle plate, and it is possible to prevent ink in the nozzle from being thickened, or being cured due to the ultraviolet light.

5 Claims, 4 Drawing Sheets

IMAGE FORMING APPARATUS

BACKGROUND

1. Technical Field

The present invention relates to an image forming apparatus which includes, an ejecting head which has a nozzle surface formed with nozzles which eject photo-curable liquid; a light irradiating unit which is arranged in the vicinity of the ejecting head, and radiates light; and a moving unit which relatively moves the ejecting head and a recording medium, and in which liquid is ejected on a recording surface of the recording medium from the nozzles, while relatively moving the recording medium and the ejecting head, and the light irradiating unit radiates light with respect to the recording surface, thereby forming an image on the recording medium.

2. Related Art

In the related art, as this type of image forming apparatus, an apparatus is proposed which includes a recording head formed with nozzles able to eject ink which is curable by ultraviolet light, and an ultraviolet light irradiation mechanism which is arranged in the vicinity of the recording head along the main scanning direction, and radiates the ultraviolet light (for example, refer to JP-A-2004-167917). A long member (optical trap) which extends along the sub-scanning direction is arranged between the recording head and the ultraviolet irradiation mechanism in the apparatus, and it is possible to capture the ultraviolet light which is input to the recording head side from an ultraviolet light source of the ultraviolet irradiation mechanism, using the optical trap. In this manner, it is possible to prevent ink in the nozzles of the recording head from being cured due to the ultraviolet light.

However, in the above described apparatus, it is necessary to provide the optical trap between the recording head and the ultraviolet irradiation mechanism, accordingly, a space for arranging the optical trap is necessary, as a result, the image forming apparatus is increased in size.

SUMMARY

An advantage of some aspects of the invention is that it provides an image forming apparatus which includes an ejecting head formed with nozzles which eject photo-curable liquid, and a light irradiating unit which is arranged in the vicinity of the ejecting head, in which it is possible to suppress curing of the liquid in the nozzle due to light, using a simple configuration.

An image forming apparatus according to an aspect of the invention includes an ejecting head which has a nozzle surface formed with nozzles which eject photo-curable liquid; a light irradiating unit which is arranged in the vicinity of the ejecting head, and radiates light; and a moving unit which relatively moves the ejecting head and a recording medium, in which liquid is ejected on a recording surface of the recording medium from the nozzles while relatively moving the recording medium and the ejecting head, and the light irradiating unit radiates light with respect to the recording surface, thereby forming an image on the recording medium, and in which the nozzle surface of the ejecting head is tilted to the recording surface of the recording medium in a direction not facing an irradiation surface of the light irradiation unit.

The image forming apparatus according to the aspect of the invention includes an ejecting head which has a nozzle surface formed with nozzles which eject photo-curable liquid; a light irradiating unit which is arranged in the vicinity of the ejecting head, and radiates light; and a moving unit which relatively moves an ejecting head and a recording medium, in which liquid is ejected on a recording surface of the recording medium from the nozzles, while relatively moving the recording medium and the ejecting head, and a light irradiating unit radiates light with respect to the recording surface, thereby forming an image on the recording medium, and in which a nozzle surface of the ejecting head is tilted to the recording surface of the recording medium in a direction not facing an irradiation surface of the light irradiation unit. In this manner, the intensity of light directed to the nozzle surface of the ejecting head from the light irradiation unit may be reduced compared to a case of not tilting the ejecting head, since the intensity of light is multiplied by cosine of the inclination of the ejecting head. As a result, the curing of the liquid in the nozzle due to light may be suppressed using a simple configuration.

Such an image forming apparatus according to aspect of the invention may have a configuration in which the moving unit is a unit which includes a main scanning direction moving unit which relatively moves the ejecting head and the recording medium in the main scanning direction, and a sub-scanning direction moving unit which relatively moves the ejecting head and the recording medium in the sub-scanning direction, the light irradiation unit is arranged in the vicinity of the ejecting head along the main scanning direction, and the nozzle surface of the ejecting head may be arranged to be tilted so as to face the opposite side to the ejecting head in the main scanning direction. In this manner, the curing of the liquid in the nozzle may be further reliably suppressed, since it is possible to reduce the light input to the nozzle surface of the ejecting head from the light irradiation unit.

Alternately, the image forming apparatus according to aspect of the invention may have a configuration in which the moving unit is a unit which includes a main scanning direction moving unit which relatively moves the ejecting head and the recording medium in the main scanning direction, and a sub-scanning direction moving unit which relatively moves the ejecting head and the recording medium in the sub-scanning direction, the light irradiation unit is arranged in the vicinity of the ejecting head along the main scanning direction, and the nozzle surface of the ejecting head is tilted in the sub-scanning direction.

In addition, the image forming apparatus according to the aspect of the invention may have a configuration in which the plurality of ejecting heads and the plurality of light irradiation units are arranged so as to be alternately aligned to each other, and the irradiation surface and the nozzle surface of at least a light irradiation unit which is interposed between the ejecting heads among the plurality of irradiation units, and the ejecting head are tilted in the same direction as each other, respectively. In this manner, it is possible to suppress the curing of liquid in the nozzle of the ejecting head, even when the image forming apparatus is a type in which the plurality of irradiation units are arranged. In this type of image forming apparatus according to the aspect of the invention may have a configuration in which the irradiation surface and the nozzle surface of the light irradiation unit and the ejecting head are tilted in the same direction as each other with approximately the same angle with respect to the recording surface of the recording medium.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
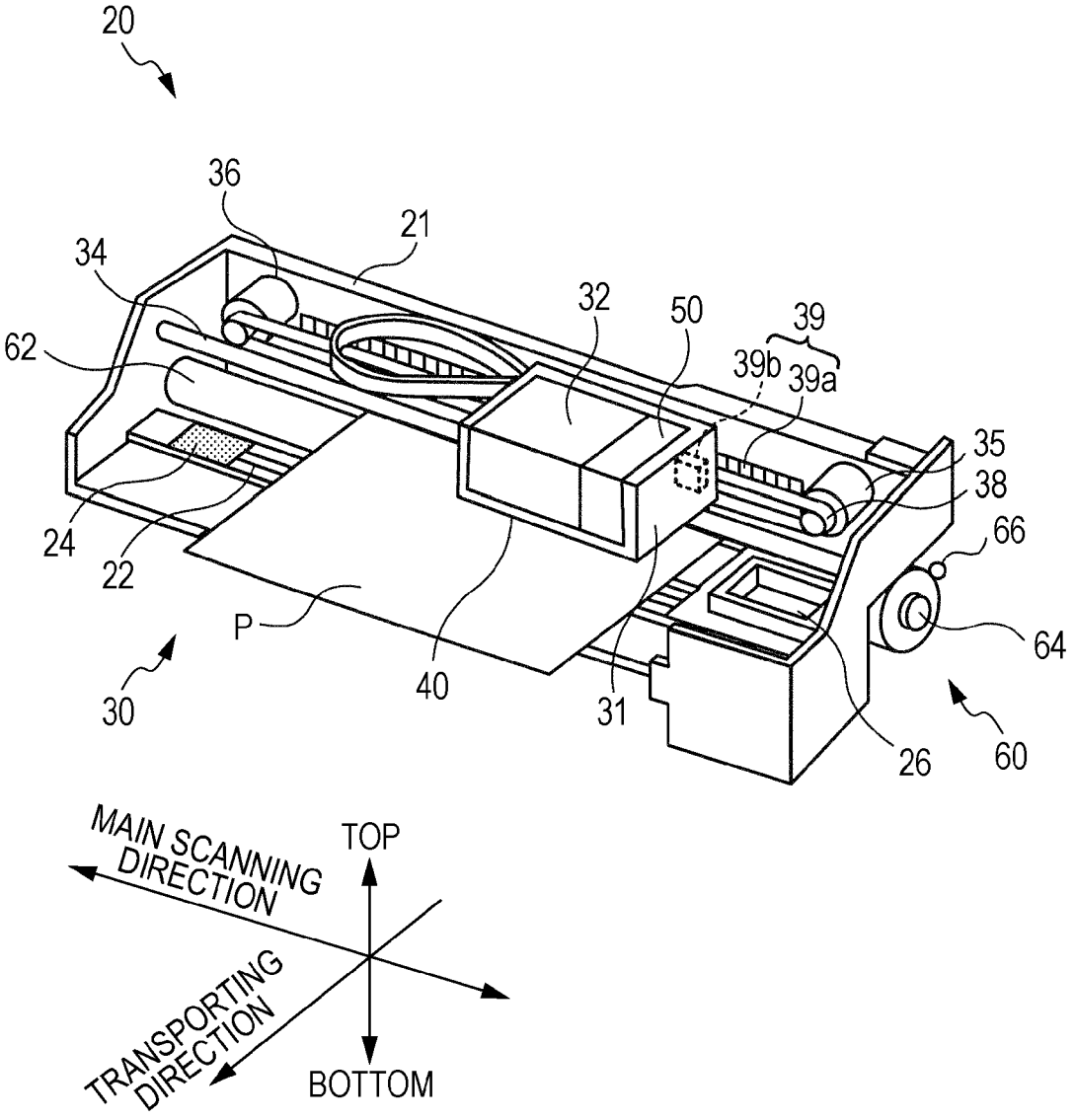
FIG. 1 is a schematic configuration diagram of an ink jet printer according to an embodiment of the invention.

Subsequently, embodiments of the invention will be described using drawings. FIG. 1 is a configuration diagram which schematically shows a configuration of an ink jet printer 20 as an embodiment of the invention, FIG. 2 is a configuration diagram which schematically shows a configuration of a printing head 40, and FIG. 3 is an explanatory diagram which shows an arrangement of the printing head 40 and an ultraviolet irradiator 50.

As shown in FIG. 1, the ink jet printer 20 according to the embodiment includes a paper feed mechanism 60 which transports a recording sheet P in the sub-scanning direction (direction of the front from the back in the figure), and a printer mechanism 30 which moves the recording sheet P which is transported onto a platen 22 by the paper feed mechanism 60 in the main scanning direction (horizontal direction in the figure), and ejects ink droplets from a nozzle of the printing head 40, thereby performing printing. In addition, a capping unit 26 which seals a nozzle surface of the printing head 40 is provided at one end of the platen 22 (right end in FIG. 1) in the main scanning direction, and a flushing area 24 for performing flushing which periodically ejects ink droplets from the nozzle of the printing head 40 in order to prevent the nozzle from clogging is provided at the other end of the platen 22 in the main scanning direction (left end in FIG. 1).

As shown in FIG. 1, the printer mechanism 30 includes a carriage 31 which is able to reciprocate in the main scanning direction while being guided by a carriage guide 34, a carriage motor 35 and driven roller 36 which are provided at one end and the opposite end of the carriage guide 34, respectively, a carriage belt 38 which stretches over the carriage motor 35 and the driven roller 36, and is attached to the carriage 31, an ink cartridge 32 which stores each color ink of cyan (C), magenta (M), yellow (Y), and black (K) which are mounted to the carriage 31, the printing head 40 in which the plurality of nozzles are formed which eject ink droplets by pressurizing each ink which is respectively supplied from the ink cartridge 32, and the ultraviolet irradiator 50 which is mounted to the carriage 31, and radiates ultraviolet light. The carriage 31 is reciprocated in the main scanning direction by driving the carriage belt 38 using the carriage motor 35. In addition, a carriage position sensor 39 for detecting a position in the main scanning direction of the carriage 31 is attached at the rear surface side of the carriage 31. The carriage position sensor 39 is configured by a linear optical scale 39*a* which is arranged in a frame 21 along the carriage 34, and an optical sensor 39*b* which is attached to the rear surface of the carriage 31 so as to face the optical scale 39*a*, and optically reads out the optical scale 39*a*.

Figure 2:
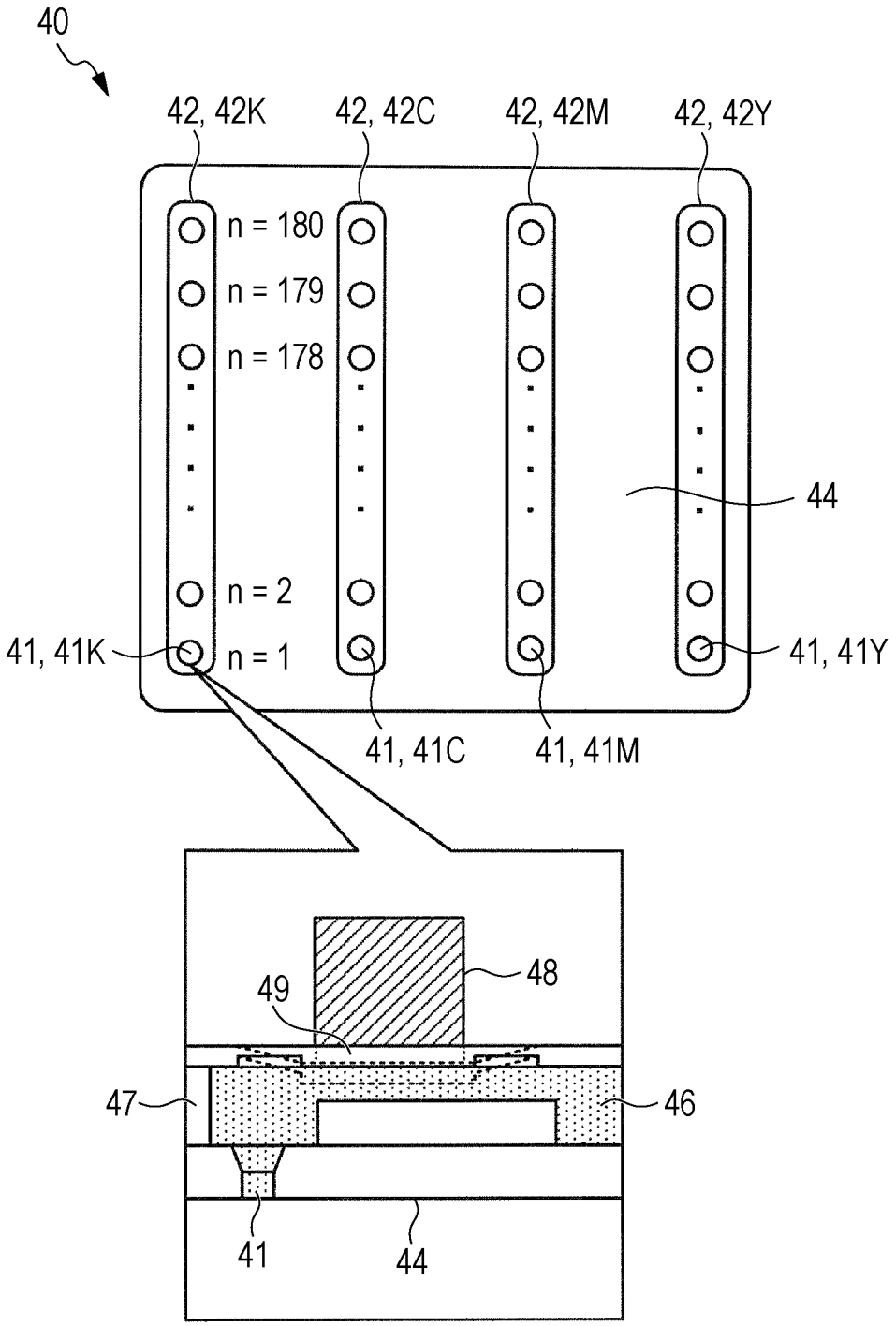
FIG. 2 is a schematic configuration diagram of a printing head.
Figure 3:
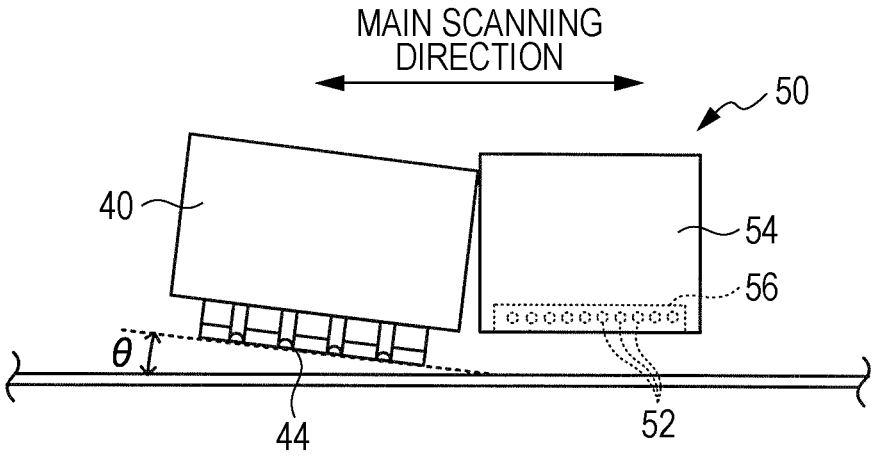
FIG. 3 is an explanatory diagram which shows an arrangement of the printing head and an ultraviolet irradiator.

As shown in FIG. 2, the printing head 40 includes a nozzle plate 44 on which four nozzle columns 42C, 42M, 42Y, and 42K in which a plurality of nozzles (180 nozzles in the embodiment) of each color of 41C, 41M, 41Y, and 41K of cyan (C), magenta (M), yellow (Y), and black (K) are arranged so as to form columns are formed, a cavity plate 47 which forms a side wall forming an ink chamber 46 which communicates with the nozzle 41, a vibrating plate 49 which forms the upper wall of the ink chamber 46, and is deformed elastically, and a piezoelectric element 48 which is arranged in the vibrating plate 49. In the printing head 40, a volume change in the ink chamber 46 is caused by applying a pulsed voltage to the piezoelectric element 48 from a driving circuit which is not shown, and vibrating the upper wall of the ink chamber 46 (vibrating plate 49), and ink is pressurized due to a contraction pressure which is generated when the volume in the ink chamber 46 is contracted, thereby ejecting the ink as ink droplets from the nozzle 41 which communicates with the ink chamber 46.

As shown in FIG. 1, the paper feed mechanism 60 includes a transporting roller 62 which transports the recording sheet P on the platen 22, and a transporting motor 64 which rotatably driving the transporting roller 62. The transporting motor 64 is attached with a rotary encoder 66 which detects the rotation amount in a rotating shaft thereof, and the driving thereof is controlled on the basis of the rotation amount from the rotary encoder 66. In addition, the rotary encoder 66 is configured by a rotary scale which is attached with gradations at intervals of a predetermined rotation angle, and a rotary scale sensor for reading out the gradations of the rotary scale which are not shown.

The ink which is stored in the ink cartridge 32 is UV-curable ink which cures when being irradiated with ultraviolet light as light, and a coloring material such as polymerizable compound, photo-initiator, a colorant, or the like is included as the component thereof.

As shown in FIG. 3, the ultraviolet irradiator 50 is configured by an ultraviolet light source 52 which radiates ultraviolet light, a concave main body 54 which accommodates the ultraviolet light source 52, and the surface on the platen 22 side is open, and a reflecting plate 56 which is provided on the inner surface of the main body 54, and reflects the ultraviolet light. The ultraviolet irradiator is arranged in the vicinity of the printing head 40 along the main scanning direction.

In addition, as shown in FIG. 3, in the printing head 40, the nozzle plate 44 is attached to be tilted with an inclination angle θ (for example, 3°, 4°, 5°, or the like) with respect to the recording surface of the recording sheet P so as to face the opposite side to the ultraviolet irradiator 50, accordingly, it is difficult for the ultraviolet light, which is radiated from the ultraviolet light source 52 of the ultraviolet irradiator 50, and is reflected on the recording sheet P, to input to the nozzle plate 44 of the printing head 40. In addition, even when the ultraviolet light is input to the nozzle plate 44, the intensity of the ultraviolet light which hits the nozzle plate 44 weakens, since the intensity of light is multiplied by cosine of the inclination angle θ. Accordingly, it is possible to prevent the ink in the nozzle 41 from being thickened or cured due to the ultraviolet light.

In the ink jet printer 20 according to the embodiment with such a configuration, when image data is received along with a printing instruction from a user computer which is not shown, the received image (RGB) data is resized, and is color converted to CMYK data, and the CMYK data after the color conversion is subject to halftone processing, and is binarized, thereby generating printing data. In addition, the recording medium P is transported onto the platen 22 by rotating the transporting roller 62 using the transporting motor 64, the carriage 31 is reciprocated by the carriage motor 35, each color ink is ejected by driving the piezoelectric elements 48 of each color of the printing head 40 at a timing corresponding to the generated printing data, thereby forming a color image on the recording medium P.

Here, according to the embodiment, the nozzle plate 44 of the printing head 40 is tilted with respect to the recording surface of the recording sheet P with the inclination angle θ, the distance between each of the nozzles 41 and the recording surface is different. For this reason, a delay circuit (not shown) is built into the driving circuit which drives the printing head 40, and an ejecting timing of the ink droplets is set to an amount of delay which is different in each nozzle 41. Specifically, when moving velocity of the carriage 31 is set to "Vc", a flying speed of ink droplets is set to "Vd", and the distance between the nozzle 41 of the printing head 40 and the recording surface of the recording sheet P is set to "D", since it is desirable to eject the ink droplets before the vertical position of the ideal landing position by the distance D·Vc/Vd from the printing head 40, it is possible to set an appropriate ejecting timing for each nozzle 41 by storing the distance D for each nozzle 41 in advance. Due to this, even when the nozzle plate 44 of the printing head 40 is tilted with respect to the printing surface of the recording sheet P, the landing position of the ink ejected from each nozzle 41 is not deviated.

Here, the correlation of the constituent elements between the embodiment and the invention will be clarified. The nozzle 41 of the embodiment corresponds to the "nozzle" of the invention, the printing head 40 corresponds to the "ejecting head", the ultraviolet irradiator 50 corresponds to the "light irradiating unit", and the carriage 31, the carriage guide 34, the carriage motor 35, the driven roller 36, or the like correspond to the "moving unit".

In the above described ink jet printer 20 according to the embodiment, since the nozzle surface (nozzle plate 44) of the printing head 40 which ejects the UV-curable ink from the nozzle 41 is tilted with respect to the recording surface of the recording sheet P with the inclination angle θ so as to face the opposite side to the ultraviolet irradiator 50, it is possible to make it difficult for the ultraviolet light which is radiated from the ultraviolet irradiator 50, and is reflected on the recording sheet P, to input to the nozzle plate 44. Accordingly, it is possible to prevent the ink in the nozzle 41 from being thickened or cured due to the ultraviolet light. Originally, since the delay circuit is built into the driving circuit for driving the printing head 40, and the ejecting timing of the ink droplets is set with the amount of delay for each of the nozzles 41, even when the nozzle plate 44 of the printing head 40 is tilted with respect to the printing surface of the recording sheet P, the landing position of the ink ejected from each nozzle 41 is not deviated.

Figure 4:
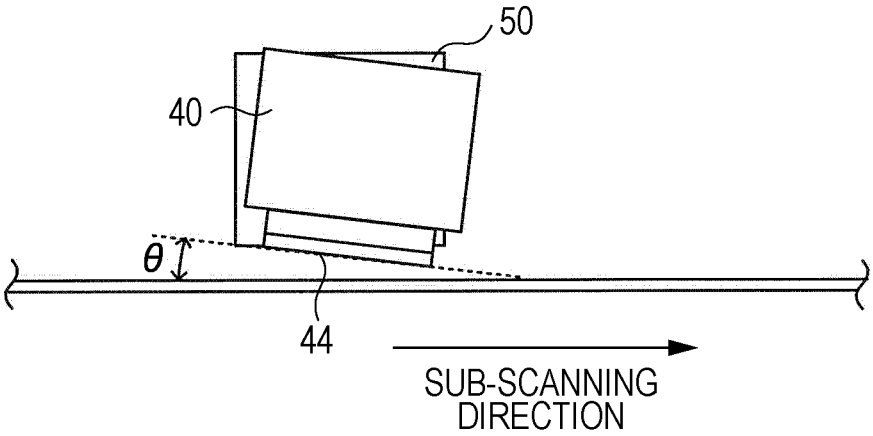
FIG. 4 is an explanatory diagram which shows an arrangement of the printing head and the ultraviolet irradiator in a modification example.

In the ink jet printer 20 according to the embodiment, the printing head 40 (nozzle plate 44) was tilted with the inclination angle θ in the main scanning direction, however, it is not limited to this, and the printing head 40 may be tilted in the sub-scanning direction (transport direction of the recording sheet P) as shown in FIG. 4. Even in this case, the intensity of the ultraviolet light hitting the nozzle plate 44 is weakened, since the intensity of light is multiplied by cosine of the inclination angle θ. Accordingly, it is possible to prevent the ink in the nozzle 41 from being thickened or cured due to the ultraviolet light. That is, it is possible to tilt the printing head 40 in any direction if the nozzle plate 44 is tilted so that the nozzle plate 44 of the printing head 40 and the irradiating surface of the ultraviolet irradiator 50 do not face each other.

Figure 5:
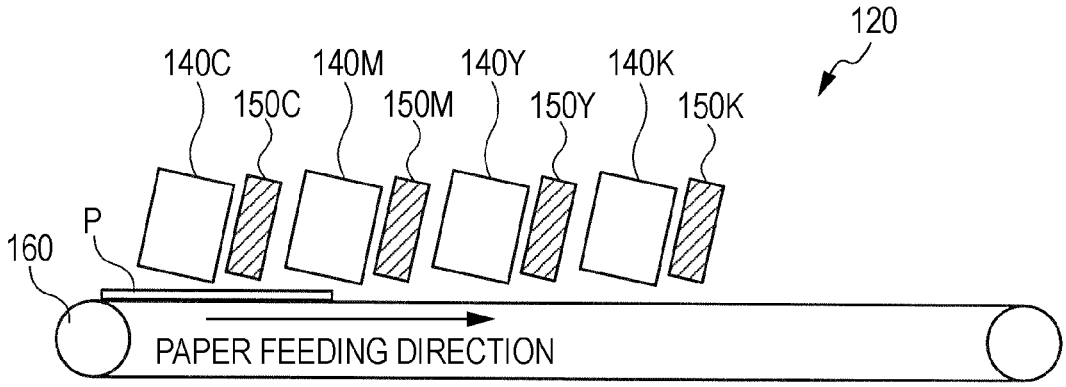
FIG. 5 is a schematic configuration diagram of an ink jet printer of a modification example.

In the ink jet printer 20 according to the embodiment, a type of printer in which a single printing head 40 and a single ultraviolet irradiator 50 are included was exemplified, however, as shown in an ink jet printer 120 as a modification example in FIG. 5, it is possible to have a configuration in which line shaped printing heads 140C, 140M, 140Y, and 140K in which nozzles are arranged so as to cover the entire sheet width for each color, and line shaped ultraviolet irradiators 150C, 150M, 150Y, and 150K which are alternately arranged with the printing heads 140C, 140M, 140Y, and 140K along the sheet feeding direction, and in which ultraviolet light sources are arranged so as to cover the entire sheet width, and a paper feed mechanism 160 for transporting the recording sheet P are included, and the printing heads 140C, 140M, 140Y, and 140K, and the ultraviolet irradiators 150C, 150M, 150Y, and 150K may be tilted with the same inclination angle in the sheet feeding direction. In addition, the ultraviolet irradiator 150K which is not interposed between the printing head may be not tilted.

Figure 6:
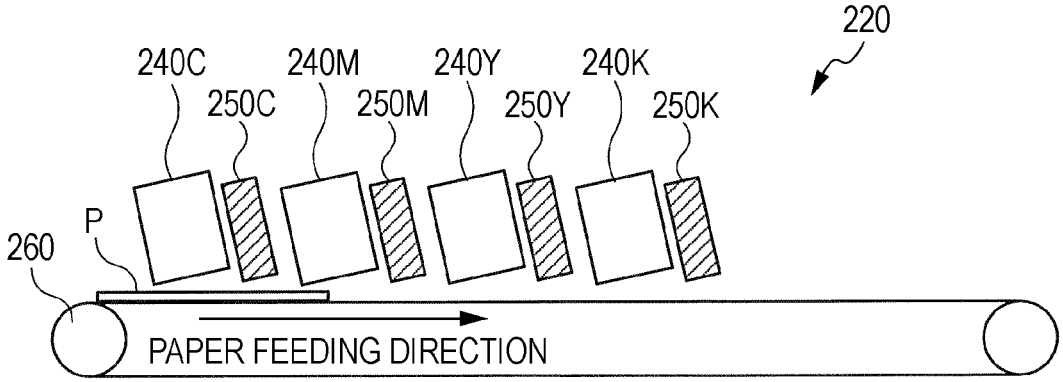
FIG. 6 is a schematic configuration diagram of an ink jet printer of a modification example.

In addition, as shown in an ink jet printer 220 as a modification example in FIG. 6, it may have a configuration in which line shaped printing heads 240C, 240M, 240Y, and 240K of which nozzles are arranged so as to cover the entire sheet width for each color, and line shaped ultraviolet irradiators 250C, 250M, 250Y, and 250K which are alternately arranged with the printing heads 240C, 240M, 240Y, and 240K along the sheet feeding direction, and in which ultraviolet light sources are arranged so as to cover the entire sheet width, and a paper feed mechanism 260 for transporting the recording sheet P are included, and the printing heads 240C, 240M, 240Y, and 240K, and the ultraviolet irradiators 250C, 250M, 250Y, and 250K may be tilted with the same inclination angle in a direction opposite to the sheet feeding direction.

Figure 7:
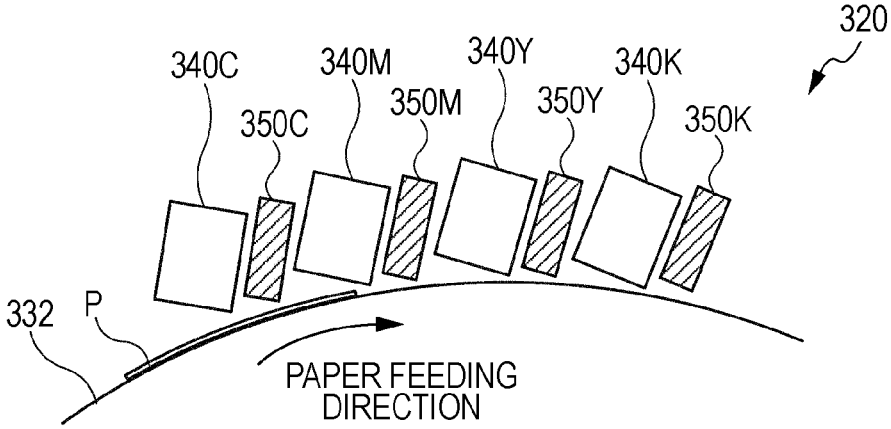
FIG. 7 is a schematic configuration diagram of an ink jet printer of a modification example.

Further, as shown in an ink jet printer 320 as a modification example in FIG. 7, it may have a configuration in which line shaped printing heads 340C, 340M, 340Y, and 340K of which nozzles are arranged so as to cover the entire sheet width for each color, line shaped ultraviolet irradiators 350C, 350M, 350Y, and 350K which are alternately arranged with the printing heads 340C, 340M, 340Y, and 340K along the sheet feeding direction, and in which the ultraviolet light sources are arranged so as to cover the entire sheet width, and a paper feed mechanism 360 for transporting the recording sheet P in an arc shape are included. In this case, each set of the printing head 340C and the ultraviolet irradiators 350C, the printing head 340M and the ultraviolet irradiators 350M, the printing head 340Y and the ultraviolet irradiators 350Y, and the printing head 340K and the ultraviolet irradiators 350K may be tilted so as to have the same inclination angle with respect to a tangent of the arc.

In the ink jet printer 20 according to the embodiment, the printing head 40 is mounted to the carriage 31, and the printing head 40 is subject to scanning in the main scanning direction with respect to the recording sheet p by moving the carriage 31, however, the ink jet printer may have a configuration in which the printing head 40 is fixed, and the recording sheet P is moved in the main scanning direction.

In addition, the invention is not limited to any of the above described embodiments, and may be executed in a variety of forms without departing from the technical scope of the invention.

The entire disclosure of Japanese Patent Application No. 2011-105636, filed May 10, 2011 is expressly incorporated by reference herein.

What is claimed is:

1. An image forming apparatus comprising:

an ejecting head which has a nozzle surface formed with nozzles which eject photo-curable liquid;

a light irradiating unit which is arranged in the vicinity of the ejecting head, and radiates light; and a moving unit which relatively moves the ejecting head and a recording medium, wherein liquid is ejected on a recording surface of the recording medium from the nozzles, while relatively moving the recording medium and the ejecting head, and the light irradiating unit radiates light with respect to the recording surface, thereby forming an image on the recording medium, wherein the nozzle surface of the ejecting head is tilted downwardly, in a downstream direction of a sub-scanning direction, in a fixed angle in a range of 3 to 5 degrees relative to the recording surface of the recording medium in a direction not facing an irradiation surface of the light irradiation unit; and a delay circuit that controls an ejection timing of each of the nozzles based on the fixed angle of the tilt.

2. The image forming apparatus according to claim 1, wherein the moving unit is a unit which includes a main scanning direction moving unit which relatively moves the ejecting head and the recording medium in a main scanning direction, and a sub-scanning direction moving unit which relatively moves the ejecting head and the recording medium in the sub-scanning direction, wherein the light irradiation unit is arranged in the vicinity of the ejecting head along the main scanning direction, and wherein the nozzle surface of the ejecting head is arranged to be tilted so as to face the opposite side to the ejection head in the main scanning direction.

3. The image forming apparatus according to claim 1, wherein the moving unit is a unit which includes a main scanning direction moving unit which relatively moves the ejecting head and the recording medium in the main scanning direction, and a sub-scanning direction moving unit which relatively moves the ejecting head and the recording medium in the sub-scanning direction, wherein the light irradiation unit is arranged in the vicinity of the ejecting head along the main scanning direction, and wherein the nozzle surface of the ejecting head is tilted in the sub-scanning direction.

4. The image forming apparatus according to claim 1, further comprising a plurality of ejecting heads and a plurality of light irradiation units, wherein the plurality of ejecting heads and the plurality of light irradiation units are arranged so as to be alternately aligned to each other, and wherein the irradiation surface and the nozzle surface of at least a light irradiation unit which is interposed between the ejecting heads among the plurality of irradiation units, and the ejecting head are tilted in the same direction as each other, respectively.

5. The image forming apparatus according to claim 4, wherein the irradiation surface and the nozzle surface of the light irradiation unit and the ejecting head are tilted in the same direction as each other with approximately the same angle with respect to the recording surface of the recording medium.

* * * * *